US008631836B2

(12) United States Patent
Desaki et al.

(10) Patent No.: US 8,631,836 B2
(45) Date of Patent: Jan. 21, 2014

(54) COOLANT VACUUM FILL APPARATUS AND METHOD

(75) Inventors: Stanley Desaki, Mercer Island, WA (US); Andrew Gall, Seattle, WA (US); Michael Moorhead, Columbus, OH (US)

(73) Assignee: PACCAR Inc, Bellevue, WA (US)

( * ) Notice: Subject to any disclaimer, the term of this patent is extended or adjusted under 35 U.S.C. 154(b) by 908 days.

(21) Appl. No.: 12/777,405

(22) Filed: May 11, 2010

(65) Prior Publication Data

US 2011/0277875 A1 Nov. 17, 2011

(51) Int. Cl.
*B67C 3/00* (2006.01)
*F01P 11/00* (2006.01)
*B67C 3/16* (2006.01)

(52) U.S. Cl.
CPC ..... *B67C 3/16* (2013.01)
USPC ..... 141/8; 141/61; 141/65; 141/59

(58) Field of Classification Search
USPC ..... 141/4–8, 39, 59, 61, 65, 98, 257, 263, 141/264, 266, 269, 312, 367, 368, 374, 381, 141/383
See application file for complete search history.

(56) References Cited

U.S. PATENT DOCUMENTS 2,660,357 A * 11/1953 Fechheimer ..... 141/13
2,898,953 A * 8/1959 Berthelsen et al. ..... 141/48
3,580,299 A * 5/1971 Alkalay et al. ..... 141/59
3,870,089 A * 3/1975 Laub, III ..... 141/44
4,889,149 A * 12/1989 Weaver et al. ..... 137/1
4,911,211 A * 3/1990 Andersen ..... 141/7
4,949,765 A 8/1990 Creeron
4,976,296 A * 12/1990 Pope ..... 141/46
5,131,497 A * 7/1992 Rogers ..... 184/1.5
5,511,590 A 4/1996 Turcotte
5,573,044 A * 11/1996 Mechalas ..... 141/83
5,573,045 A * 11/1996 Akazawa ..... 141/92
5,649,574 A 7/1997 Turcotte
5,673,733 A 10/1997 Turcotte
6,360,790 B1 * 3/2002 Klamm et al. ..... 141/98
6,584,994 B2 7/2003 Knowles
6,588,445 B2 7/2003 Knowles
6,742,535 B1 6/2004 Knowles
6,959,717 B2 11/2005 Knowles
7,213,619 B2 5/2007 Awad
7,316,363 B2 * 1/2008 Hume et al. ..... 239/263
2011/0240173 A1 * 10/2011 Brandt et al. ..... 141/8

* cited by examiner

*Primary Examiner* — Timothy L Maust
*Assistant Examiner* — Robert Bell, III
(74) *Attorney, Agent, or Firm* — Christensen O'Connor Johnson Kindness PLLC

(57) ABSTRACT

An apparatus, system, and method are provided for bypassing a coolant reservoir with a fill tool connecting a source of vacuum pressure and a source of coolant (e.g., a vacuum coolant filler) to a vehicular cooling system inlet port. The fill tool bypass allows the coolant reservoir to be manufactured from a relatively structurally weak polymer material, which is subject to failure under vacuum pressure, while still allowing vacuum coolant filling to be used to charge the vehicular cooling system. Without the use of the bypass fill tool, the coolant reservoir would rupture under the vacuum pressures applied during vacuum coolant filling.

8 Claims, 6 Drawing Sheets

COOLANT VACUUM FILL APPARATUS AND METHOD

BACKGROUND

The cooling system is essential for proper operation of vehicles of many types. Particularly, large trucks (e.g., medium- or heavy-duty trucks) rely heavily on the cooling system for optimum operation and the protection of the vehicle from overheating.

Because of the complexity of the cooling systems in large trucks, special manufacturing techniques have been developed to fill the cooling system with coolant for operation. Vacuum filling is a particularly useful technique, wherein a vacuum (e.g., 20 torr) is applied to a closed cooling system and coolant is then flushed into the evacuated cooling system. Vacuum filling helps to eliminate detrimental effects, such as trapped air pockets, which arise during traditional filling (e.g., non-vacuum) of a vehicular cooling system.

While vacuum filling of vehicular cooling systems can lead to increased efficiency when charging new vehicular cooling systems with coolant within a manufacturing plant, the vacuum filling technique is not without drawbacks. Particularly, the relatively high vacuum required for the method can lead to stress, strain, and possibly structural failure, of the individual components of the cooling system.

One particular component of a vehicular cooling system that is susceptible to structural failure when subjected to the high vacuum pressures of vacuum coolant filling is the coolant reservoir, which is the entry point for coolant into a vehicular cooling system. The coolant reservoir is traditionally manufactured from an inexpensive and lightweight material, such as blow-molded plastic. Such a plastic is not structurally sufficient to withstand the relatively high vacuum of the vacuum filling technique described above, and rupture of the coolant reservoir may result.

One potential solution to the structural susceptibility to failure of the coolant reservoir is to manufacture the reservoir from a more robust material, such as metal, that would withstand the applied vacuum pressures. However, the coolant reservoir is not a vital component in the cooling system and, after charging of the cooling system with coolant, the coolant reservoir is used very lightly, and only under standard temperatures and pressures (i.e., the coolant reservoir does not need to withstand further vacuum pressures after the cooling system has been charged with coolant). Thus, investing additional manufacturing cost into designing, implementing, and manufacturing a more robust coolant reservoir is not a financially viable option for a manufacturer because significant additional cost would be invested for a benefit that is not passed on to the end customer. For example, a customer does not require a metallic coolant reservoir and would not likely want to pay a premium for such a component when its only benefit is to allow the manufacturer to use a vacuum coolant filling process.

A second option for overcoming the structural failure of the coolant reservoir during vacuum filling is to remove the coolant reservoir prior to vacuum filling. However, during a typical large-truck manufacturing process, the coolant reservoir is attached to the cooling system prior to the step of charging the cooling system with coolant. Thus, for the coolant reservoir to be removed prior to charging of the cooling system, additional labor and inefficiencies would be generated when detaching the coolant reservoir, filling the cooling system, and then reattaching the coolant reservoir.

What is desired, therefore, is a practical solution that would allow for vacuum filling of a cooling system with coolant that allows manufacturers to continue to use inexpensive (e.g., blow-molded polymer) coolant reservoirs while taking full advantage of the vacuum coolant filling technique. And to perform such an action in the typically small amount of time allotted on a production line for filling a cooling system (e.g., less than 5 minutes).

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The embodiments disclosed herein provide a solution to the problem experienced when vacuum filling a cooling system of a vehicle with coolant, wherein the cooling system includes a coolant reservoir that does not possess the structural integrity (e.g., a reservoir made from plastic, such as a blow-molded plastic) to withstand the pressures of the vacuum filling without rupture. In the disclosed embodiments, a bypass fill tool and method for using the fill tool are provided. The fill tool provides liquid communication between the vacuum filling system and the vehicular cooling system while passing by the structurally weak coolant reservoir.

The fill tool is manufactured from a material, such as a metal, that is capable of withstanding the vacuum pressures of the vacuum fill process. The fill tool bypasses the coolant reservoir during the vacuum filling process, allowing the vehicular cooling system to be filled with the vacuum filling process while allowing inexpensive plastic to be used for manufacturing the coolant reservoir.

DESCRIPTION OF THE DRAWINGS

The foregoing aspects and many of the attendant advantages of embodiments provided herein will become more readily appreciated as the same become better understood by reference to the following detailed description, when taken in conjunction with the accompanying drawings, wherein.

DETAILED DESCRIPTION

A fill tool is provided that is useful for bypassing a coolant reservoir of a vehicular cooling system during vacuum filling of the cooling system with coolant (also referred to herein as "charging" the cooling system with coolant). Because blow-molded polymer coolant reservoirs, which are typically used as coolant reservoirs in large trucks, are susceptible to structural failure (e.g., rupture) during vacuum coolant filling, the provided fill tool bypasses the coolant reservoir and allows for gaseous and liquid communication between a source of vacuum pressure and a source of coolant (e.g., a vacuum coolant filling apparatus) and the vehicular cooling system.

Figure 1:
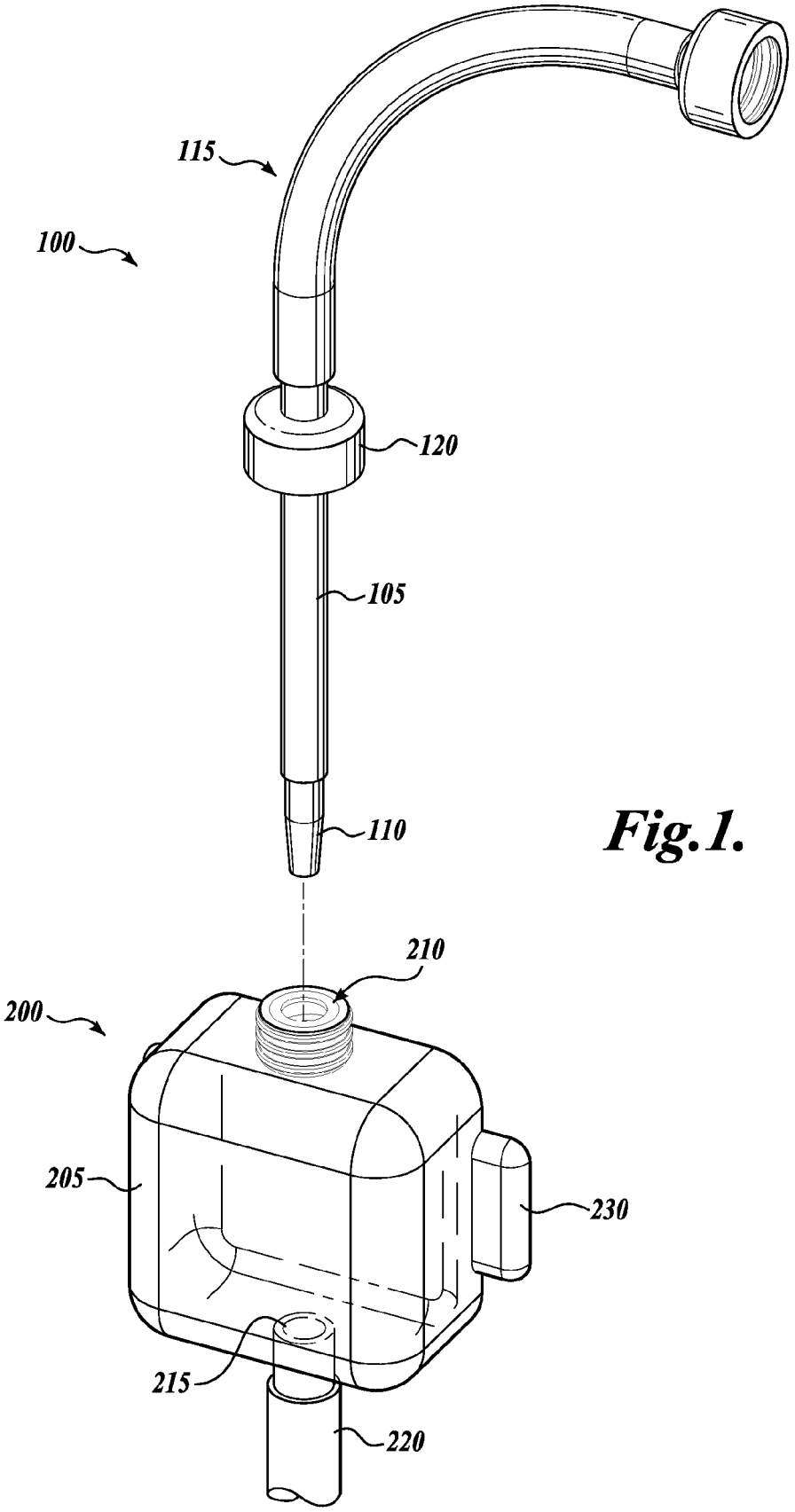
FIG. 1 illustrates a representative embodiment of a fill tool, a coolant reservoir, and a portion of a vehicular cooling system in accordance with the embodiments provided herein.

Referring to FIG. 1, two components are illustrated: First, a fill tool 100 in accordance with the embodiments disclosed herein; and, second, a representative coolant reservoir 200, such as those found in vehicular cooling systems. Additionally, a portion of a vehicular cooling system is embodied in the vehicular cooling system inlet port 220.

The fill tool 100 is formed from a material capable of withstanding the pressures of vacuum coolant filling (e.g., a vacuum pressure of 20 torr/29.13 in Hg and a filling pressure of 50 psig). Typical materials for fabricating the fill tool 100 include metals (e.g., stainless steel), structurally robust polymers, and combinations thereof. The fill tool 100 includes an elongated hollow member 105. In a representative embodiment, the hollow member 105 is a tubular hollow member. The hollow member 105 includes a distal end 110 at the tip of the fill tool 100. The distal end 110 is configured to be received in an inlet 220 of the vehicular cooling system (not illustrated), to which the fill tool 100 is attached during vacuum filling of coolant.

The fill tool 100 including the hollow member 105 and distal end 110 is in liquid communication with a vacuum fill apparatus (not illustrated) through a channel at a proximal end 115. The proximal end 115 may be a single channel connecting the hollow member 105 to the vacuum coolant filler (not illustrated), or may include several of the following structural features: Valves, braided steel flexible tubular portions, hoses, and connectors/fittings that provide linkages between any of the provided components.

In a representative embodiment, the coolant reservoir 200 is manufactured from a blow-molded polymer such as \polypropylene, polyethylene (e.g., HDPE), acrylonitrile butadiene-styrene (ABS), polyphenylene oxide (PPO), and polyethylene terephthalate (PET). A coolant reservoir 200 made from metal, or any other material, is also contemplated. The coolant reservoir 200 includes a coolant reservoir body 205, a coolant reservoir inlet 210, and a coolant reservoir outlet 215. As illustrated in FIG. 1, the reservoir outlet 215 is adjacent to the vehicular cooling system inlet 220, which is in fluid communication with the remainder of the vehicular cooling system. The polymer used to manufacture the coolant reservoir 200 is not compatible with the pressures of a typical vacuum coolant filler, and thus, the fill tool 100 is adapted to bypass the coolant reservoir 200 and insert directly into the cooling system inlet 220 to provide liquid communication between a vehicular cooling system and a vacuum coolant filler.

In an exemplary embodiment, the fill tool 100 is about 10" long and ¾" in diameter. A 12" stainless steel braided line ½" in diameter connects the fill tool 100 to a vacuum coolant filler.

Figure 2:
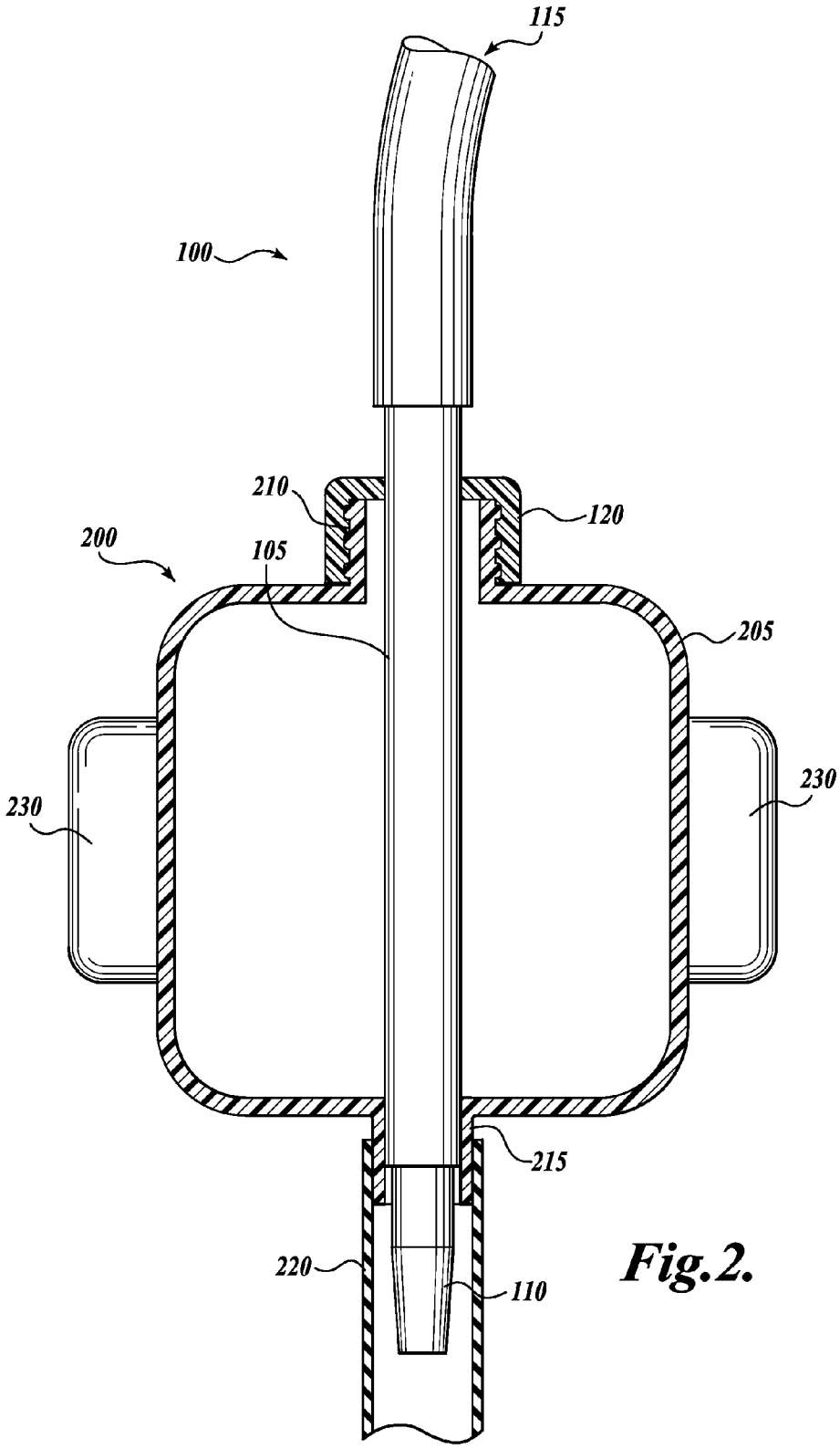
FIG. 2 illustrates the parts illustrated in FIG. 1 combined such that the fill tool is inserted through the coolant reservoir and into the vehicular cooling system so as to bypass the reservoir.

Referring to FIG. 2, the fill tool 100 is illustrated bypassing a coolant reservoir 200 (illustrated in cross section along with fill tool cap 120 and vehicular coolant system inlet port 220) to attach to (e.g., be sealably inserted into) the vehicular coolant system inlet port 220, which is in liquid communication with the remainder of a vehicular coolant system (not illustrated). The cross-sectional parts of the figure help to illustrate more clearly the passage of the fill tool 100 through the coolant reservoir 200. The fill tool 100 provides a liquid communication conduit between a vacuum coolant filler (not illustrated) attached to the proximal end 115 of the fill tool 100, and the vehicular coolant system. In the embodiment illustrated in FIG. 2, the distal end 110 of the fill tool 100 is inserted through the coolant reservoir outlet 215 and protrudes into the vehicular coolant system inlet port 220. In this embodiment, friction between the hollow member 105 of the fill tool and the walls of the coolant reservoir outlet 215 provides the attachment necessary to seal the distal end 110 within the vehicular coolant system inlet port 220 such that operation of the fill tool 100 as an aspect of a vacuum coolant filler for filling the vehicular coolant system with coolant will not subject the coolant reservoir 200 to the pressures of the vacuum coolant filling apparatus in use.

In the illustrated embodiment of FIGS. 1 and 2, a number of optional features are included, such as attachment flanges 230 extending from opposite sides of the coolant reservoir 200. The attachment flanges 230 can be used to screw, bolt, clamp, or otherwise attach the coolant reservoir 200 to the desired location within the vehicular engine area.

Additionally illustrated in FIGS. 1 and 2 is a fill tool cap 120 configured to be threaded onto a threaded coolant reservoir inlet 210 to provide downward pressure on the hollow member 105 and the distal end 110 of the fill tool 100. Providing pressure on the fill tool 100 can aid in sealably attaching the distal end 110 to the coolant reservoir outlet 215 and/or the vehicular coolant system inlet port 220.

It will be appreciated by those of skill in the art that several means for sealably attaching the distal end 110 of the fill tool 100 to the vehicular coolant system inlet port 220 are contemplated. Friction and the dimensions of the fill tool 100 and coolant reservoir 200 are used in the embodiment illustrated in FIG. 2, whereas a spring mechanism, including washers and gaskets, is described further below and illustrated in FIGS. 3 and 4. Any attachment method is compatible with the embodiments disclosed herein Referring to FIG. 3, an embodiment of the fill tool 300 is illustrated in exploded view that includes a spring 330 configured to sealably attach the fill tool 300 to the inlet port 220 of the vehicular cooling system (not illustrated). The fill tool 300 includes an elongated hollow member 305, a distal end 310, a proximal end 315 having a connection 317 to a vacuum coolant filler (not illustrated), and a connector 320 for joining the proximal end 315 and the elongated hollow member 305.

Figure 3:
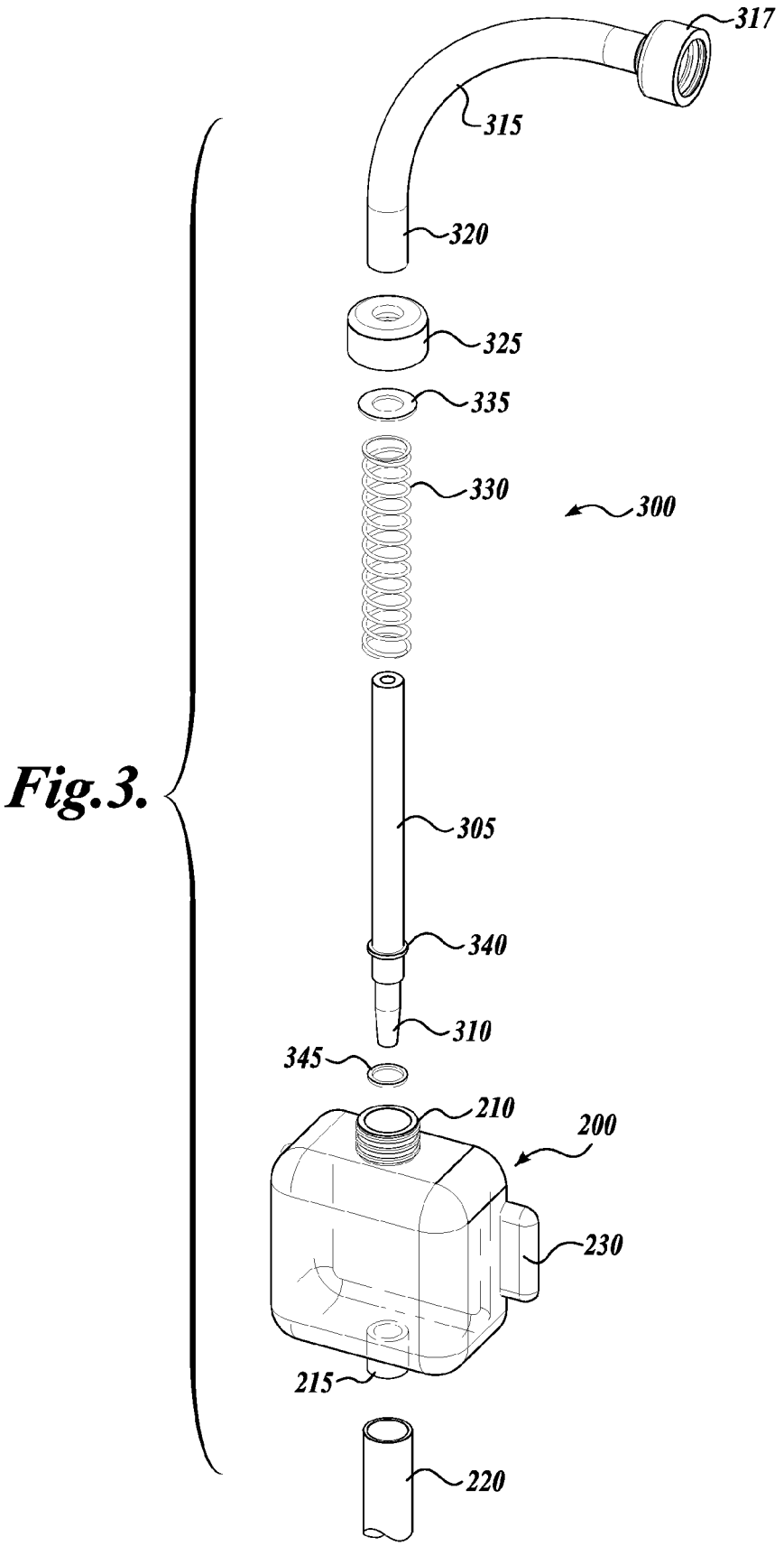
FIG. 3 is a representative fill tool, coolant reservoir, and a portion of a vehicular cooling system, shown in exploded view, in accordance with the embodiments disclosed herein.

The embodiment of the fill tool 300 illustrated in FIG. 3 additionally includes a mechanism for biasing the distal end 310 of the fill tool 300 into the coolant reservoir outlet 215/vehicular cooling system inlet port 220 so as to seal the distal end 310 to the coolant reservoir outlet 215/vehicular cooling system inlet port 220. The fill tool 300 includes a fill tool cap 325, through which is threaded the hollow member 305. Situated within the fill tool cap 325, and having the hollow member 305 threaded therethrough, is a cap washer 335 providing resistance to the spring 330 sheathed around the elongated hollow member 305. The spring is seated toward the distal end 310 of the fill tool 300 on a flange 340 provided on hollow member 305. In use, the fill tool 300 is inserted through the coolant reservoir 200, and the distal end 310 is sealed to either the coolant reservoir outlet 215 or the vehicular cooling system inlet port 220.

A coolant reservoir outlet gasket 345 provides additional structure for facilitating sealing between the vehicular cooling system inlet port 220 and the fill tool 300. The distal end 310 of the fill tool 300 is inserted through the coolant reservoir outlet gasket 345 until the coolant reservoir outlet gasket 345 abuts the flange 340.

Figure 4:
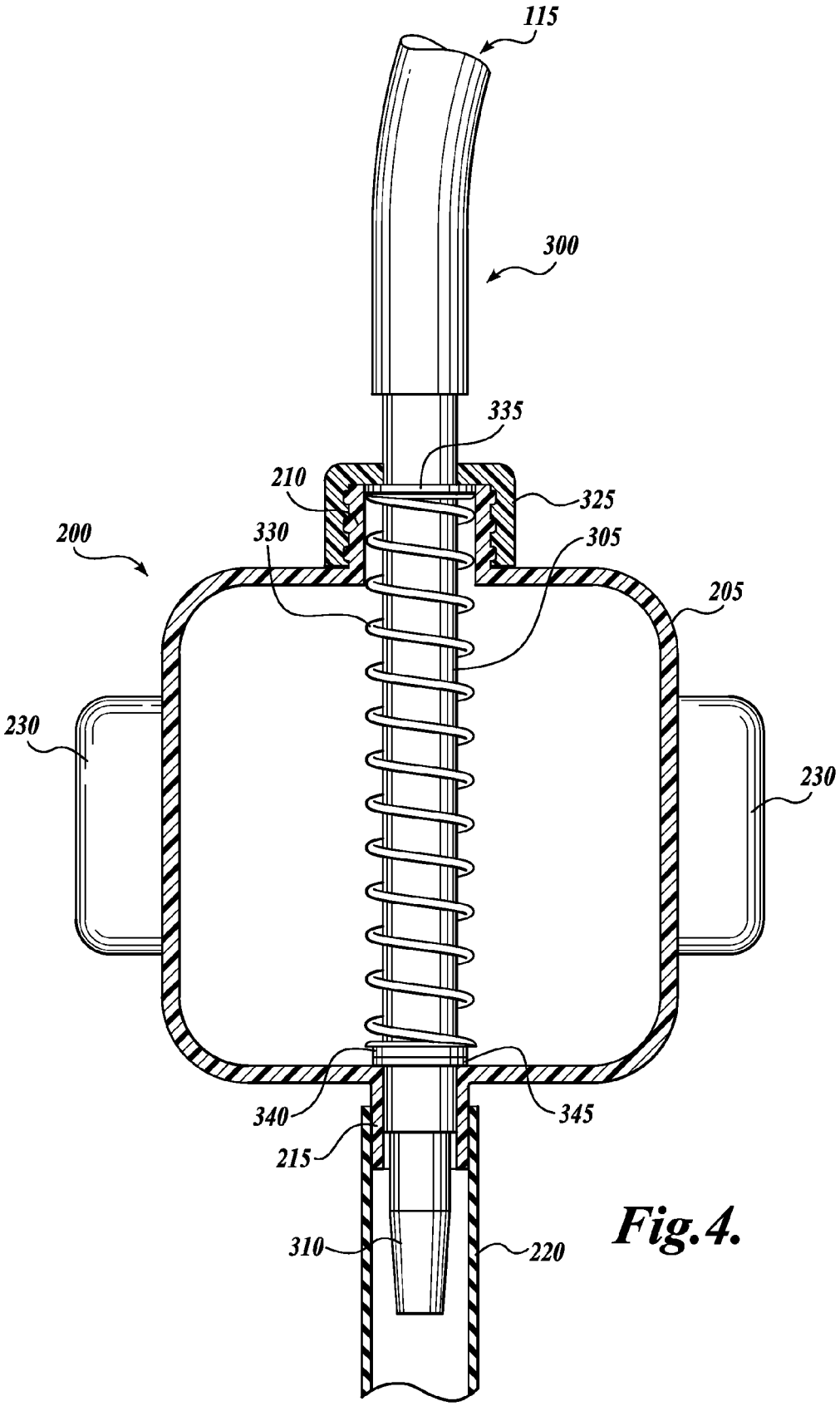
FIG. 4 illustrates the parts illustrated in FIG. 3 combined such that the fill tool is inserted through the coolant reservoir so as to bypass the reservoir.

Referring to FIG. 4, the assembly of FIG. 3 is illustrated (with the coolant reservoir 200, fill tool cap 325, and inlet port 220, illustrated in cross section) in a state wherein the fill tool 300 is sealably inserted (attached) into the coolant reservoir outlet 215, with the coolant reservoir outlet gasket 345 intermediate the coolant reservoir outlet 215 and the flange 340 attached to the fill tool 300. Pressure is applied to the coolant reservoir outlet gasket 345 through the flange 340, pressed by the spring 330 upon the application of force to the cap washer 335. Force is applied to the cap washer 335, and thus transferred to the coolant reservoir outlet gasket 345 (in this exemplary embodiment), by screwing the threaded fill tool cap 325 onto the threaded coolant reservoir inlet 210. As the fill tool cap 325 is threaded onto the coolant reservoir inlet 210, the spring 330 is compressed, and the compression force acts to sealably attach the fill tool 300 to the vehicular cooling system inlet port 220 to provide liquid communication between the fill tool 300 and the vehicular cooling system 225 while bypassing the coolant reservoir 200 and avoiding exposure of the coolant reservoir 200 to the vacuum pressures of vacuum coolant filling.

Figure 5A:
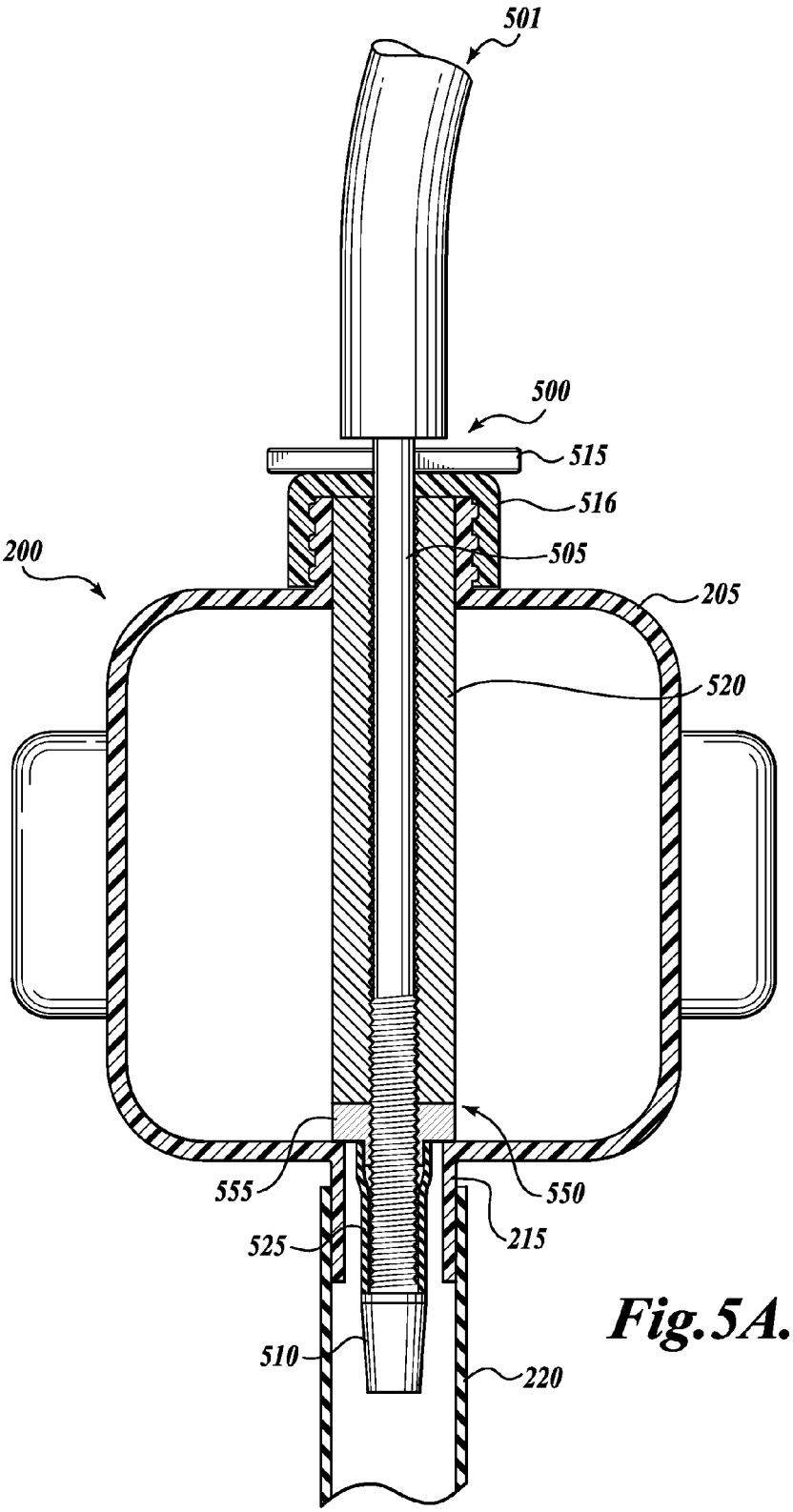
FIGS. 5A and 5B illustrate another representative embodiment of a fill tool, a coolant reservoir, and a portion of a vehicular cooling system in accordance with the embodiments provided herein.
Figure 5B:
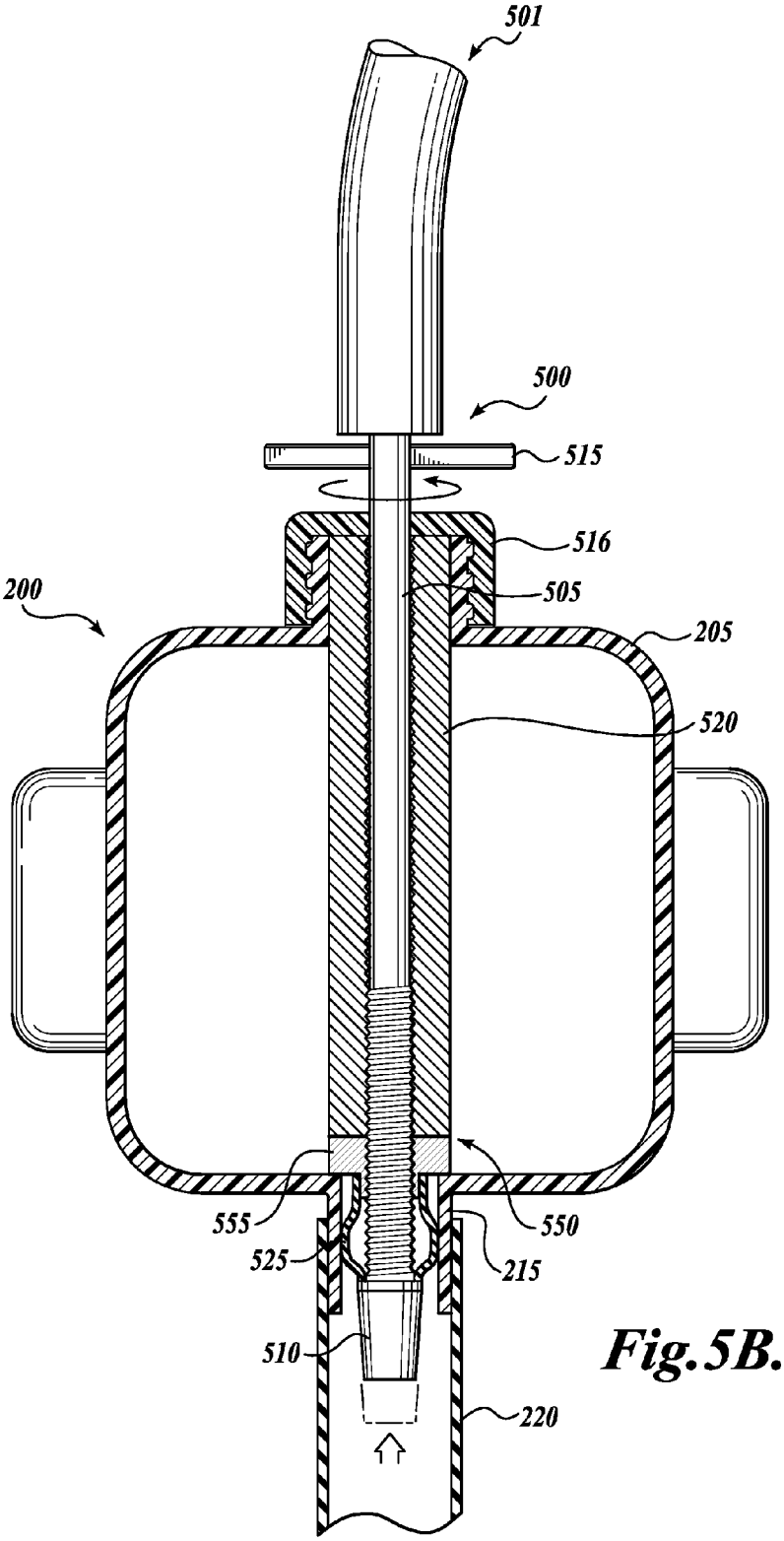

In another embodiment, illustrated in FIGS. 5A and 5B, a fill tool 500 is provided having an expandable seal 525 disposed at the distal end of the fill tool 500 for sealing the fill tool 500 in the coolant reservoir outlet 215/vehicular cooling system inlet port 220. Coolant flows from a proximal end 501 (attached to a source of vacuum and coolant, not illustrated), through an inner tube 505, and out of a distal end 510. The inner tube 505 is housed in a sleeve 520 such that the proximal end 510 can be moved longitudinally in relation to the sleeve 520.

In FIG. 5A, the expandable seal 525 is in a radially retracted, longitudinally elongated position, wherein the distal end 510 of the inner tube 505 is extended longitudinally a distance away from the sleeve 520 such that the expandable seal 525 is pulled taught against the inner tube 505. No seal between the fill tool 500 and coolant reservoir outlet 215 is formed in the configuration of the fill tool 500 shown in FIG. 5A.

In FIG. 5B, a second position of the fill tool 500 provides a seal between the expandable seal 525 and the reservoir outlet 215. The expandable seal 525 is radially expanded and longitudinally contracted by the movement of the distal end 510 longitudinally towards the sleeve 520. Because the expandable seal 525 is attached to both the distal end 510 and the sleeve 520, the movement of the distal end 510 radially expands the expandable seal 525 to seal off the coolant reservoir outlet 215; thus allows for vacuum filling of the cooling system without subjecting the coolant reservoir 200 to the vacuum pressures of the process.

It will be appreciated that there are several mechanisms suitable for utilizing an expandable seal 525 integrated with a fill tool 500. In the embodiment of FIGS. 5A and 5B, the distal end 510 is moved in relation to the sleeve 520 using a screw-thread mechanism wherein a portion of the external surface of the inner tube 505 includes male screw threading that is engaged with female screw threading on the inner surface of the sleeve 520. A disc 515 is mechanically connected to the inner tube 505 such that rotation of the disc 515 will rotate the inner tube 505 in relation to the sleeve 520, which is rotationally immobilized by way of its attachment to the fill cap 516. A break 550 in the sleeve 520 separates the body of the sleeve 520 from a rotatable sleeve 555 portion. The rotatable sleeve 555 freely rotates, whereas the body of the sleeve 520 does not rotate. The expandable seal 525, rotatable sleeve 555, and inner tube 520 all rotate simultaneously when the disc 515 is rotated. Depending on the rotation direction of the disc 515, the expandable seal 525 is either radially expanded or contracted, thus creating and destroying a seal with the coolant reservoir outlet 215, respectively.

In an exemplary embodiment, the fill tool 500 is about 10" long and ¾" in diameter. A 12" stainless steel braided line ½" in diameter connects the fill tool 100 to a vacuum coolant filler. The fill tool 500 can fill a vehicular cooling system in less than five minutes on a vehicle assembly line. Known methods are not capable of achieving such an efficient filling time.

In an exemplary use of the fill tool 500 to bypass a coolant reservoir 200 during vacuum filling of a vehicular cooling system with coolant, a new vehicle on an assembly line arrives at a work station for charging with coolant. The fill tool 500 is inserted into the empty coolant reservoir 200. The distal end 510 is manually inserted into the coolant reservoir outlet 215 and the fill tool cap 516 is tightened onto the coolant reservoir inlet 210. The previous steps are performed with the expandable seal 525 in a radially contracted position, such as that of FIG. 5A. Upon insertion into the coolant reservoir outlet 215, the disc 515 is rotated such that the expandable seal 525 radially expands and forms a seal with the coolant reservoir outlet 215. Vacuum coolant filling is then initiated. When coolant filling is completed, the disc 515 is rotated in the opposite direction to release the seal. The fill tool cap 516 is then unscrewed and the fill tool 500 is removed from the coolant reservoir 200, thus completing the process.

In the embodiments disclosed herein, the fill tool has a proximal end configured to attach to a source of coolant and a source of vacuum pressure. As described above with regard to FIGS. 1-5B, the source of coolant and the source of vacuum pressure are embodied in a single apparatus, the vacuum coolant filler. It will be appreciated that the source of coolant and the source of vacuum pressure do not need to be embodied in the same apparatus, although a single vacuum coolant filler apparatus is convenient for the embodiments described herein.

In another aspect, a system for vacuum filling a vehicular coolant system is provided. In one embodiment, the system includes a source of coolant and a source of vacuum pressure (e.g., combined in a vacuum coolant filler); and a fill tool for bypassing a coolant reservoir during vacuum filling of the vehicular cooling system with a liquid coolant from the source of coolant, the fill tool being in liquid communication with the source of coolant and the source of vacuum, and comprising an elongated hollow member configured to pass through the coolant reservoir, the hollow member including a distal end and a proximal end, the distal end being configured to form an airtight seal with an inlet port of the vehicular cooling system, and the proximal end being attached to the source of coolant and the source of vacuum pressure.

The system provided is similar to the fill tool described above, with the additional inclusion of the vacuum coolant filler attached to the proximal end of the fill tool. FIGS. 1-5B essentially illustrate the systems disclosed herein, although the vacuum coolant filler is not illustrated. Instead, as has been described above, the proximal end (e.g., 115, 315) of the fill tool (e.g., 100, 300) is in fluid communication with the vacuum coolant filler of the system.

In the embodiments provided herein, typical pressure ranges used during the vacuum-filling process are from −30 to 50 psi.

In a further embodiment, the system includes the vehicular coolant system comprising the coolant reservoir, which includes a coolant reservoir inlet and a coolant reservoir outlet, wherein the coolant reservoir outlet is in liquid communication with the coolant system inlet port.

In another aspect, a method is provided for vacuum filling a vehicular cooling system with coolant. In one embodiment, the method includes the steps of providing a vehicular cooling system comprising a coolant reservoir having a coolant reservoir inlet and a coolant reservoir outlet, the coolant reservoir outlet being in liquid communication with a cooling system inlet port; providing a source of coolant; providing a source of vacuum pressure; providing a fill tool, comprising an elongated hollow member configured to pass through the coolant reservoir of the vehicular cooling system, the hollow member including a distal end and a proximal end, the distal end being configured to form an airtight seal with an inlet port of the vehicular cooling system, and the proximal end being attached to the source of coolant and the source of vacuum pressure; attaching the fill tool to the vehicular cooling system inlet port by passing the elongated hollow member through the coolant reservoir inlet and coolant reservoir outlet to form an airtight seal between the distal end and the inlet port; applying a vacuum from the source of vacuum pressure to the cooling system inlet port through the fill tool; and delivering coolant from the source of coolant to the cooling system inlet port through the fill tool.

The method has been described above with regard to the provided fill tool and system for vacuum filling a vehicular cooling system. The fill tool and system are both used in the provided methods and the above descriptions are applicable to the methods described herein.

The method begins with the step of providing a vehicular cooling system comprising a coolant reservoir having a coolant reservoir inlet and a coolant reservoir outlet, the coolant reservoir outlet being in liquid communication with a coolant system inlet port. As described above, the vehicular coolant system includes a coolant reservoir attached to an inlet port of the vehicular coolant system.

The method continues with the steps of providing a source of coolant and a source of vacuum pressure. These sources can be separately provided, or provided by a single apparatus, as described above.

The method continues with the step of providing a fill tool, comprising an elongated hollow member configured to pass through the coolant reservoir of the vehicular cooling system, the hollow member including a distal end and a proximal end, the distal end being configured to form an airtight seal with an inlet port of the vehicular cooling system, and the proximal end being attached to the source of coolant and the source of vacuum pressure. The fill tool useful in the method has been described above in detail.

The method continues with a step of attaching the fill tool to the vehicular cooling system inlet port by passing the elongated hollow member through the coolant reservoir inlet and coolant reservoir outlet to form an airtight seal between the distal end and the inlet port. The embodiments disclosed herein bypass the coolant reservoir so as to utilize vacuum filling of coolant in a vehicular cooling system. Thus, this step describes the insertion of the fill tool through the coolant reservoir by way of passing through the coolant reservoir inlet and the coolant reservoir outlet after which the fill tool is attached to the cooling system inlet port.

The method concludes with the steps of applying a vacuum from the source of vacuum pressure to the cooling system inlet port through the fill tool; and delivering coolant from the source of coolant to the cooling system inlet port through the fill tool. After the fill tool is attached to the cooling system inlet port, the source of vacuum pressure can be operated, and vacuum pressure is applied to the cooling system directly through the fill tool without exposing the coolant reservoir to the vacuum pressures of the process. Once evacuated, coolant is filled into the cooling system from the source of coolant.

In one embodiment, the vehicular cooling system is void of coolant prior to performing the provided method. In an exemplary embodiment, the coolant system is void of coolant during the assembly of a newly manufactured vehicle, and the method can be performed in the vehicle manufacturing environment (e.g., at a manufacturing plant).

In one embodiment, the fill tool further comprises a spring configured to press the elongated hollow member towards the inlet port of the vehicular coolant system. In a further embodiment, the fill tool further comprises a coolant reservoir cap through which the elongated hollow member passes, said coolant reservoir cap being freely movable in rotatable and longitudinal directions with relation to the elongated hollow member; wherein the elongated hollow member comprises a flange; and wherein the elongated hollow member fits through the spring longitudinally such that a first end of the spring abuts the flange and a second end of the spring abuts the coolant reservoir cap. Similar embodiments are additionally contemplated for the methods and systems disclosed herein.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for vacuum filling a vehicular cooling system with coolant, comprising:

providing a vehicular cooling system comprising a coolant reservoir having a coolant reservoir inlet and a coolant reservoir outlet, the coolant reservoir outlet being in liquid communication with a cooling system inlet port;

providing a source of coolant;

providing a source of vacuum pressure;

providing a fill tool, comprising an elongated hollow member configured to pass through the coolant reservoir of the vehicular cooling system, the hollow member including a distal end and a proximal end, the distal end being configured to form an airtight seal with an inlet port of the vehicular cooling system, and the proximal end being attached to the source of coolant and the source of vacuum pressure;

attaching the fill tool to the vehicular cooling system inlet port by passing the elongated hollow member through the coolant reservoir inlet and coolant reservoir outlet to form an airtight seal between the distal end and the inlet port;

applying a vacuum from the source of vacuum pressure to the cooling system inlet port through the fill tool; and delivering coolant from the source of coolant to the cooling system inlet port through the fill tool.

2. The method of claim 1, wherein the fill tool distal end comprises an expandable seal configured to radially expand so as to form the airtight seal between the distal end of the elongated hollow member and the inlet port of the vehicular coolant system; and wherein forming an airtight seal in the step of attaching the fill tool to the vehicular cooling system inlet port comprises radially expanding the expandable seal.

3. The method of claim 2, wherein the distal end of the elongated hollow member is longitudinally movable in relation the body of the elongated hollow member; wherein the expandable seal has a first end disposed on the body of the elongated hollow member and a second end disposed on the distal end of the elongated hollow member; and wherein movement of the distal end of the elongated hollow member longitudinally towards the body of the elongated hollow member causes the expandable seal to radially expand and longitudinally contract.

4. The method of claim 1, wherein the source of coolant and the source of vacuum pressure are both a vacuum coolant filler.

5. The method of claim 1, wherein the vehicular cooling system is void of coolant.

6. The method of claim 1, wherein applying a vacuum comprises applying a pressure between 50 psig and 29.13 inHg.

7. The method of claim 1, wherein the elongated hollow member can withstand vacuum pressures without rupturing.

8. The method of claim 1, wherein the elongated hollow member is a tube.

* * * * *